US007509689B2

(12) United States Patent
Reardon et al.

(10) Patent No.: US 7,509,689 B2
(45) Date of Patent: Mar. 31, 2009

(54) BATHING PONCHO

(76) Inventors: Timothy A. Reardon, 2424 Stonehaven Ct., West, Orange Park, FL (US) 32065; Brenda L. Reardon, 2424 Stonehaven Ct., West, Orange Park, FL (US) 32065

( * ) Notice: Subject to any disclaimer, the term of this patent is extended or adjusted under 35 U.S.C. 154(b) by 0 days.

(21) Appl. No.: 11/445,199

(22) Filed: Jun. 2, 2006

(65) Prior Publication Data

US 2007/0157359 A1 Jul. 12, 2007

Related U.S. Application Data

(60) Provisional application No. 60/756,584, filed on Jan. 6, 2006.

(51) Int. Cl.
*A41D 3/08* (2006.01)

(52) U.S. Cl. ..... 2/88; 2/84

(58) Field of Classification Search ..... 2/67, 2/69, 84, 88, 171.2, 174; 132/212
See application file for complete search history.

(56) References Cited

U.S. PATENT DOCUMENTS 2,520,160 A * 8/1950 MacQuarrie ..... 401/201
2,757,384 A * 8/1956 Slater ..... 4/601
2,875,167 A * 2/1959 Minor et al. ..... 442/121
3,004,269 A * 10/1961 Dillier ..... 441/98
3,088,469 A * 5/1963 Berryhill et al. ..... 132/212
3,146,464 A * 9/1964 Burnett ..... 2/49.3
3,522,612 A * 8/1970 Palmer ..... 2/88
3,639,915 A * 2/1972 Hrubecky ..... 2/114
3,719,955 A * 3/1973 Hrubecky ..... 2/243.1
3,896,807 A * 7/1975 Buchalter ..... 604/289
3,922,723 A * 12/1975 Popper ..... 2/113
4,118,802 A * 10/1978 Polster ..... 2/84
4,261,061 A * 4/1981 McAlvage ..... 2/239
4,646,364 A * 3/1987 O'Larey ..... 2/50
4,783,856 A 11/1988 Bouwens et al.
4,948,585 A * 8/1990 Schlein ..... 424/404
5,101,512 A * 4/1992 Weinstein ..... 2/84
5,444,113 A * 8/1995 Sinclair et al. ..... 524/306
5,720,043 A 2/1998 White, Sr.

(Continued)

FOREIGN PATENT DOCUMENTS

CN 1307095 A * 8/2001

(Continued)

OTHER PUBLICATIONS

Alimed: Medical and Ergonomic Products for Healthcare, Business, and Home; QualCare Shower Poncho; http://www.alimed.com/ProductDetail.asp?style=77721 &fprd=QualCare%26trade%3B+Shower+Poncho&oid1=&oid2=; p. 1-2.*

(Continued)

*Primary Examiner*—Alissa L Hoey
(74) *Attorney, Agent, or Firm*—Richard C. Litman

(57) ABSTRACT

Disposable garments adapted to be donned while bathing or showering and drying off. The garments take the form of ponchos. The bathing or showering poncho will have a different color than the drying poncho. Also the bathing/showering poncho will have soap and shampoo impregnated therein. Both ponchos will have ties on the sides thereof to secure the poncho and prevent inadvertent exposure.

8 Claims, 4 Drawing Sheets

U.S. PATENT DOCUMENTS

| | | | | |
|---|---|---|---|---|
| 5,963,986 | A * | 10/1999 | Deppen | 2/50 |
| 6,026,822 | A * | 2/2000 | Skiba et al. | 132/212 |
| 6,047,706 | A * | 4/2000 | Skiba et al. | 132/200 |
| 6,327,711 | B1 * | 12/2001 | Fujiwara | 2/69 |
| 6,351,852 | B1 * | 3/2002 | Propp | 2/174 |
| 6,351,867 | B1 * | 3/2002 | Forster | 15/121 |
| D465,317 | S | 11/2002 | Darling | |
| 6,760,921 | B1 * | 7/2004 | Simmons | 2/84 |
| 6,820,283 | B2 * | 11/2004 | Graneto, III | 2/171.2 |
| D507,693 | S | 7/2005 | Walton | |
| 6,918,138 | B2 * | 7/2005 | Donovan | 2/174 |
| 6,996,853 | B2 * | 2/2006 | Gabriel | 2/174 |
| 2004/0255363 | A1 * | 12/2004 | Gabriel | 2/171.2 |
| 2005/0102727 | A1 * | 5/2005 | Kelly | 2/69 |

FOREIGN PATENT DOCUMENTS

| | | | |
|---|---|---|---|
| DE | 1949976 | A * | 4/1971 |
| GB | 2220557 | A * | 1/1990 |
| JP | 2005330620 | A * | 12/2005 |

OTHER PUBLICATIONS

Neuro Feedback Consult; Shower Shield; http://www.neurofeedbackconsult.com/Ourline.html; p. 1-2; as of Dec. 19, 2006.*

Neuro Feedback Consult; Shower Shield; http://web.archive.org/web/20040921215946/http://www.neurofeedbackconsult.com/Ourline.html; p. 1-2; as of Sep. 21, 2004.*

* cited by examiner

BATHING PONCHO

CROSS-REFERENCE TO RELATED APPLICATION

This application claims the benefit of U.S. Provisional Patent Application Ser. No. 60/756,584, filed Jan. 6, 2006.

BACKGROUND OF THE INVENTION

1. Field of the Invention

The present invention generally relates to wearing apparel. More specifically, the present invention is drawn to a disposable poncho adapted for wear while bathing or showering.

2. Description of the Related Art

In institutions such as hospitals, nursing homes, college dormitories, gyms, and the like, the bathing or showering facilities often lack the privacy to which one is accustomed to at home. Thus, becoming unclad to take a shower or a bath can be somewhat of an unpleasant and embarrassing experience. A covering that would preserve one's dignity by minimizing exposure while also insuring a thorough cleansing would certainly be a welcome addition in the marketplace.

There are many bath and/or shower coverings disclosed in the related art. Pertinent examples of such related art are cited and identified in the accompanying IDS. However, none of the cited and identified related art discloses a versatile poncho covering as will subsequently be described and claimed in the instant invention.

SUMMARY OF THE INVENTION

The present invention is drawn to disposable garments adapted to be donned while bathing or showering and drying off. The garments take the form of ponchos. As contemplated, the bathing or showering poncho will have a different color than the drying poncho. Also the bathing/showering poncho will have soap and shampoo impregnated therein. Both ponchos will have ties on the sides thereof to secure the poncho and prevent inadvertent exposure.

Accordingly, the invention presents bathing and drying garments that can be easily donned. The garments are fabricated from disposable, biodegradable material. The invention provides for improved elements thereof in an arrangement for the purposes described that are inexpensive, dependable and fully effective in accomplishing their intended purposes.

A clear understanding of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
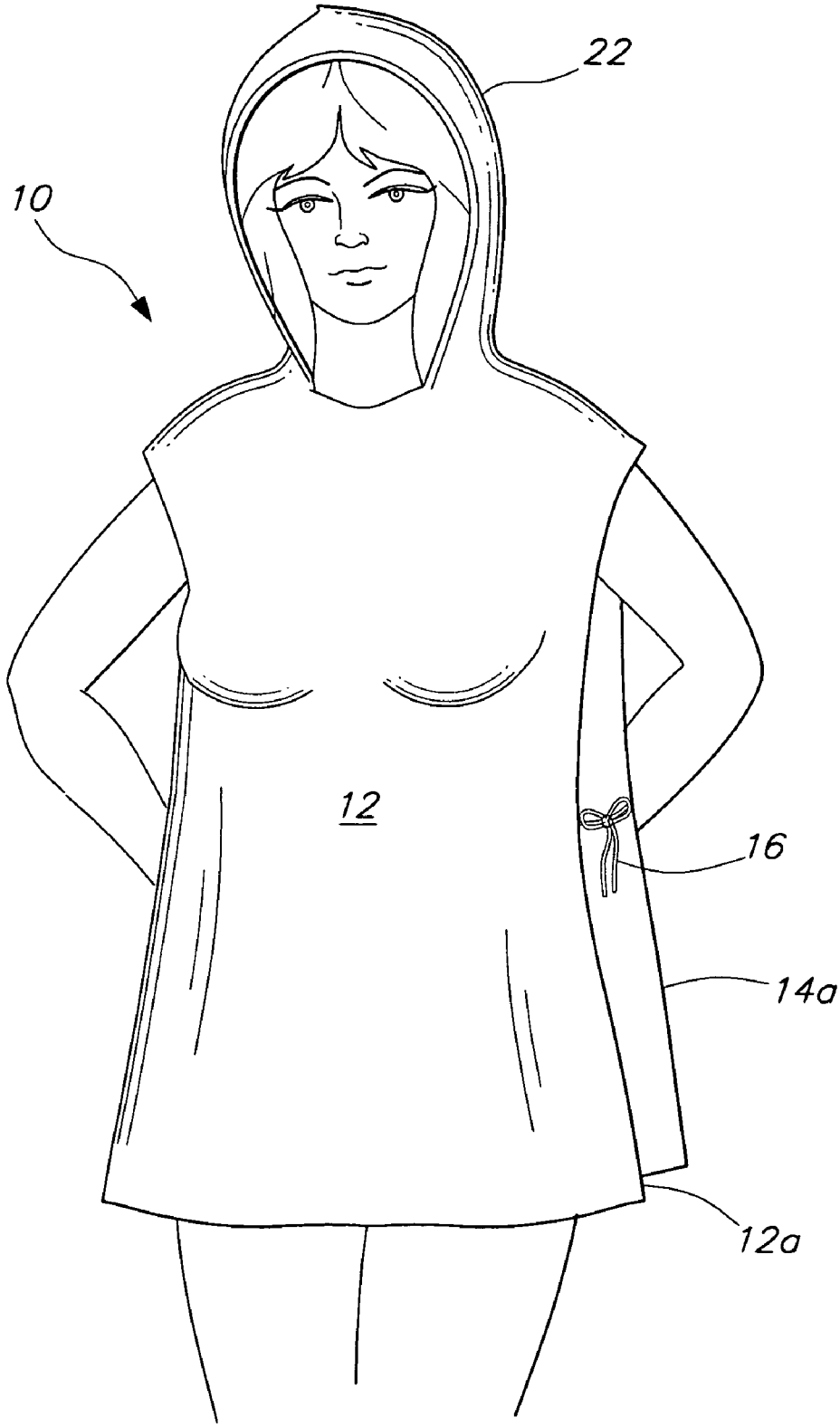
FIG. 1 is an environmental, perspective, front view of a bathing poncho according to the present invention.
Figure 2:
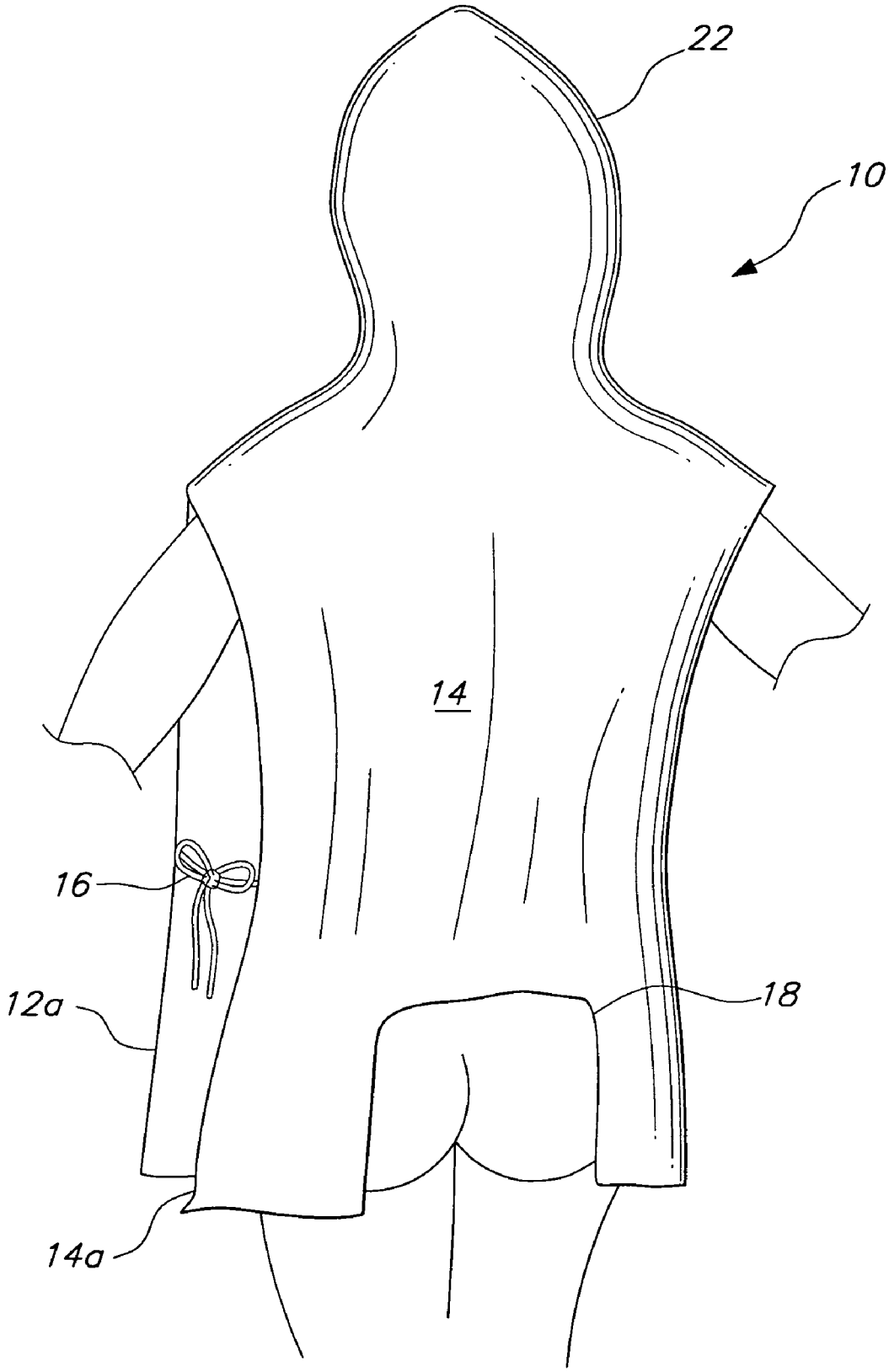
FIG. 2 is an environmental, perspective, rear view of a bathing poncho according to the present invention.

Attention is first directed to FIGS. 1 and 2 wherein the poncho of the present invention is generally indicated at 10.

Poncho 10 includes front and rear panels 12 and 14 having respective edges 12*a* and 14*a*. Ties 16 are positioned on the edges to allow the wearer to secure the poncho for minimum exposure. A rear opening 18 allows a user to employ a shower seat if desired. Hood 22 is employed to cover the wearer's head.

Figure 3:
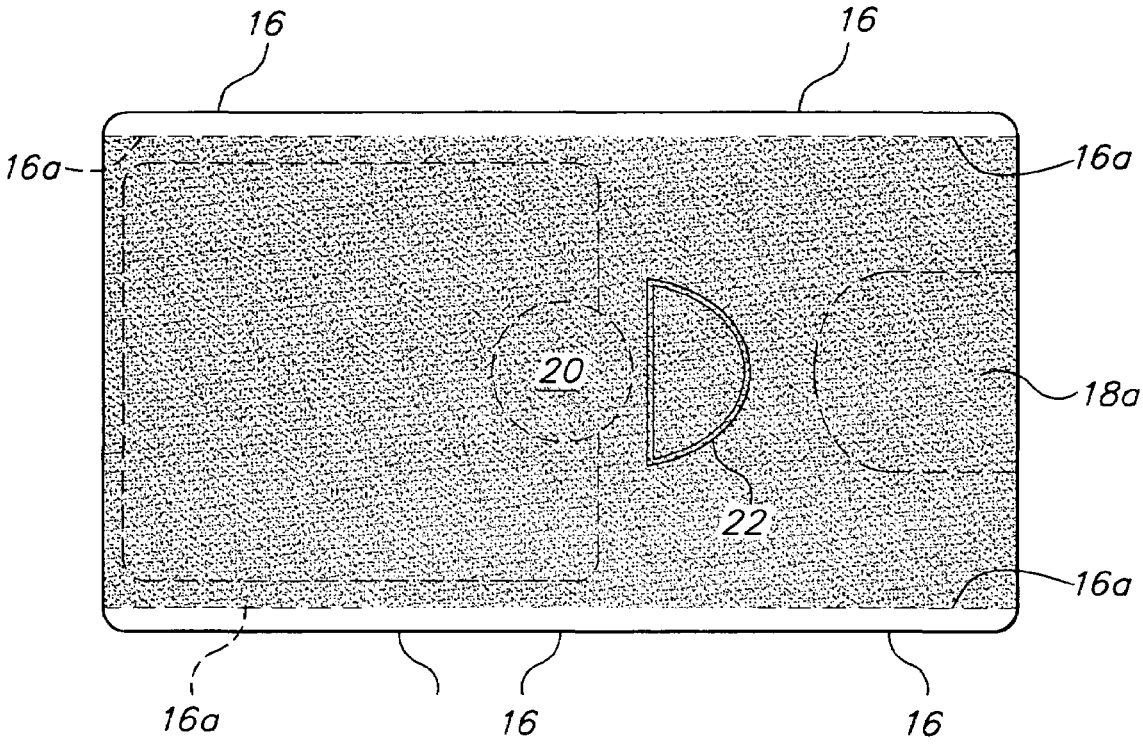
FIG. 3 is a plan view of a bathing poncho according to the present invention.

As best seen in FIG. 3, the poncho is fabricated from a single sheet of material having perforations 16*a* extending adjacent to and parallel with edges 12*a* and 14*a* to define ties 16. Both front panel 12 and rear panel 14 are impregnated with non-rinse soap (shaded area). Circular portion 20 is perforated around its circumference and can be removed to allow access for the wearer's head. Removed portion 20 can be used as a washcloth. A hood 22 is positioned adjacent portion 20. Hood 22 is impregnated with a non-rinse shampoo. A portion 18*a* of back panel is perforated along its perimeter so as to be easily removable to expose opening 18 if desired. If used as a drying poncho, no soap or shampoo will be impregnated in the panels or the hood. Also, the hood may be omitted in the drying embodiment. The poncho can be made in a variety of sizes for adults and children.

Figure 4:
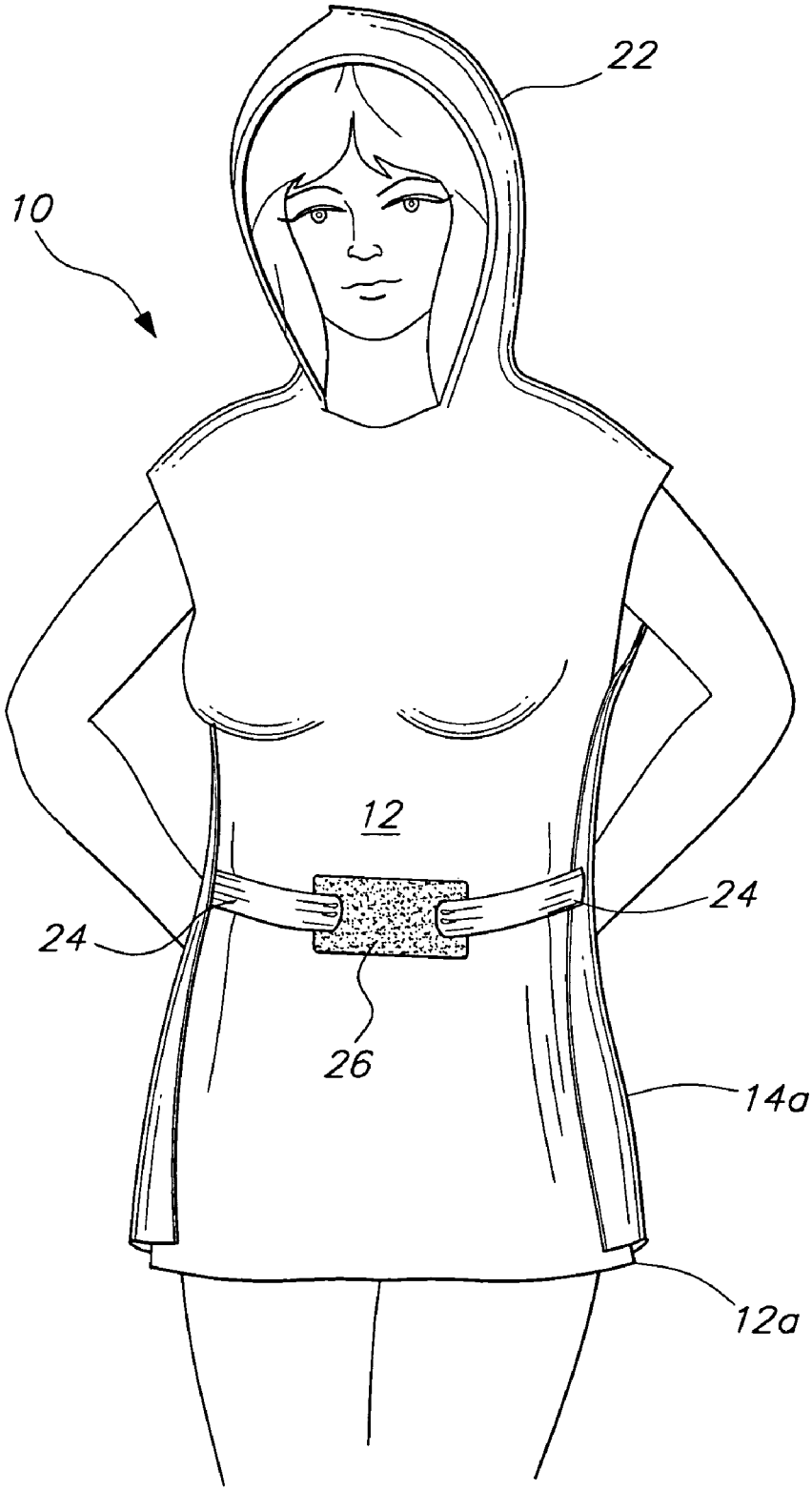
FIG. 4 is an environmental, perspective view of a second embodiment of a bathing poncho according to the present invention.

FIG. 4 illustrates a second embodiment of the invention wherein straps 24 are employed to fasten the poncho instead of ties. The straps are secured to conventional hook and loop fastening material 26, which material is attached to the front panel of the hood.

It is to be understood that the present invention is not limited to the embodiments described above, but encompasses any and all embodiments within the scope of the following claims.

We claim:

1. Bathing garment, comprising:

a rectangular sheet, said sheet fabricated from disposable, biodegradable material, said sheet having edges, a front panel and a rear panel;

a quantity of non-rinse soap impregnated in at least one of said front and rear panels;

a circular member disposed in said sheet, said circular member having a circumference;

an array of perforations formed along said circumference, whereby said circular member is removable to form an opening in said sheet; and a hood attached to said sheet and positioned adjacent said circular member.

2. The bathing garment according to claim 1, further including, a quantity of non-rinse shampoo impregnated in said hood.

3. The bathing garment according to claim 1, further including perforations embedded in said sheet and extending adjacent to and parallel with said edges.

4. A bathing garment, comprising:

a rectangular sheet, said sheet fabricated from disposable, biodegradable material, said sheet having edges, a front panel and a rear panel;

a quantity of non-rinse soap impregnated in said front panel and said rear panel;

a circular member disposed in said sheet, said circular member having a circumference;

an array of perforations formed along said circumference, whereby said circular member is removable to form an opening in said sheet; and a hood attached to said sheet and positioned adjacent said circular member.

5. The bathing garment according to claim 4, further including, a quantity of non-rinse shampoo impregnated in said hood.

6. The bathing garment according to claim 4, further including perforations embedded in said sheet and extending adjacent to and parallel with said edges.

7. A bathing garment, comprising:

a rectangular sheet, said sheet fabricated from disposable, biodegradable material, said sheet having edges, a front panel and a rear panel;

a quantity of non-rinse soap impregnated in said front panel and said rear panel;

a circular member disposed in said sheet, said circular member having a circumference;

an array of perforations formed along said circumference, whereby said circular member is removable to form an opening in said sheet;

a hood attached to said sheet and positioned adjacent said circular member;

a quantity of non-rinse shampoo impregnated in said hood; and perforations embedded in said sheet and extending adjacent to and parallel with said edges.

8. The bathing garment according to claim 7, further including a hook and loop fastener attached to said front panel.

* * * * *